United States Patent [19]

Dreissigacker et al.

[11] 4,396,188

[45] Aug. 2, 1983

[54] STATIONARY ROWING UNIT

[76] Inventors: Peter D. Dreissigacker; Richard A. Dreissigacker, both of R.F.D. 2, Box 242, Morrisville, Vt. 05661; Jonathan V. Williams, R.D. #1, Box 184-A, Waterbury Center, Vt. 05667

[21] Appl. No.: 283,658

[22] Filed: Jul. 15, 1981

[51] Int. Cl.[3] ..... A63B 21/02; A63B 69/06

[52] U.S. Cl. ..... 272/72; 272/128; 272/DIG. 5

[58] Field of Search ..... 272/72, 142, 135, 136, 272/138, 143, 144, DIG. 5, 120, 128

[56] References Cited

U.S. PATENT DOCUMENTS

| | | | |
|---|---|---|---|
| 1,974,445 | 9/1934 | Calleson | 272/72 |
| 2,725,231 | 11/1955 | Hoover | 272/72 |
| 3,558,130 | 1/1971 | Anderson | 272/72 |
| 3,586,322 | 6/1971 | Kverneland | 272/72 |
| 4,249,725 | 2/1981 | Mattox | 272/128 X |

FOREIGN PATENT DOCUMENTS

| | | | |
|---|---|---|---|
| 83817 | 11/1957 | Denmark | 272/72 |
| 7706583 | 1/1979 | Sweden | 272/72 |
| 371950 | 4/1973 | U.S.S.R. | 272/72 |

*Primary Examiner*—Richard C. Pinkham
*Assistant Examiner*—William R. Browne
*Attorney, Agent, or Firm*—Thomas N. Neiman

[57] ABSTRACT

The unit includes a single rowing and seat component connected to a simplified braking mechanism. The slideable seat is attached to a monorail frame. The braking unit has an adjustably geared flywheel connected to a plurality of fan-type blades. The rowing component includes a handle attached to a drive chain which propels the flywheel.

6 Claims, 3 Drawing Figures

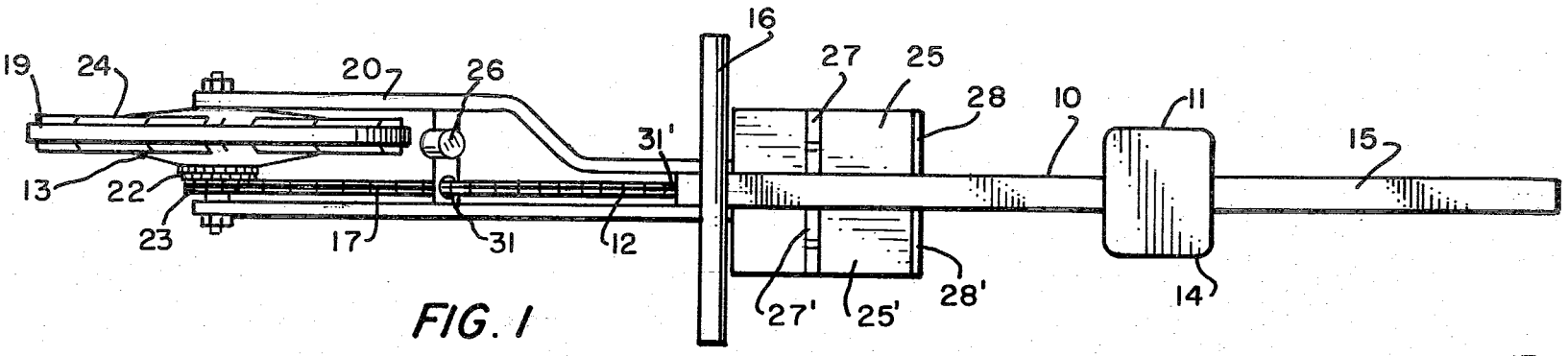
FIG. 1
FIG. 3
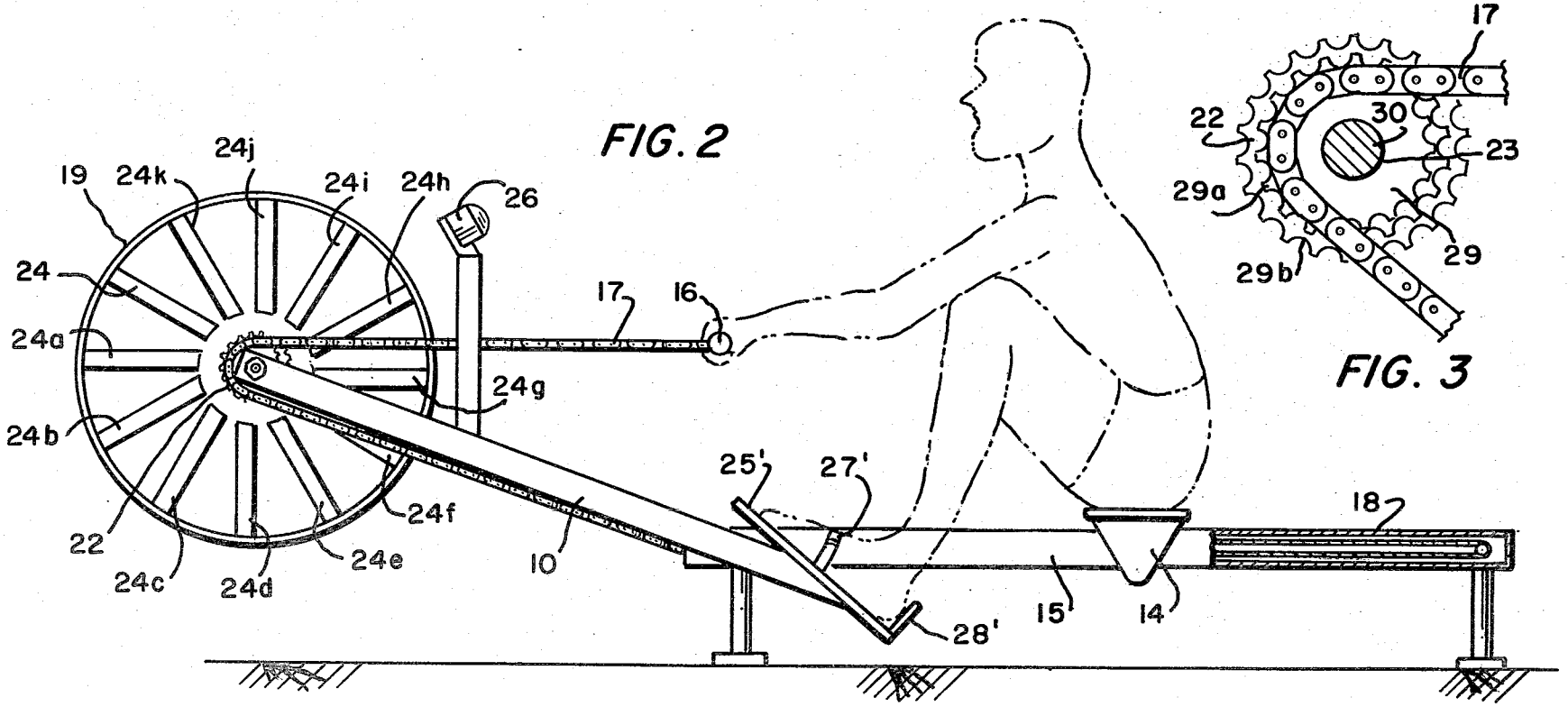
FIG. 2

STATIONARY ROWING UNIT

This invention pertains to exercise devices and to exercise rowing units, particularly to units which use a braking system that produces a repeatable resistance that allows the operator's output level to be measured simply and accurately. It also pertains to units which provide a "feel" which is similar to the actual sensation of rowing a boat.

In the prior art, it is typical to provide a friction brake to provide the resistance necessary for training. Those units have a number of inherent disadvantages including the buildup of heat and wear in the units. Additionally, coefficient of friction fluctuations result in measurement errors unless the unit includes specific compensation equipment. There have been improvements to the above described devices such as shown, for instance, in U.S. Pat. No. 3,315,959, issued Apr. 25, 1967 to G. Carnielli, for A Hinge and Braking Device for Stationary Rowing Excercising Apparatuses. Other devices which can be used as examples of current state-of-the-art devices are in the patent issued to A. R. Johnson on Aug. 16, 1966, U.S. Pat. No. 3,266,801 for a Fluid-Operated Rowing Machine and in the patent issued to P. Elia et. al., U.S. Pat. No. 3,380,737 on Apr. 30, 1968, for a Rowing-Type Exercising Equipment.

As shown in these patents, the devices use a variety of methods to simulate the sensations of rowing and providing the resistance necessary to improve performance and endurance. It can be difficult to provide accurate sensation and resistance which is similar to that experienced in actual rowing and is measurable and to achieve these goals simply and at least possible cost. Recently a number of units have included electronic circuitry to this end. Accordingly, it is an object of this invention to set forth a stationary rowing unit which provides an inexpensive, simple means of resistance which is measurable, reproduceable and similar to that experienced in actual rowing shells and also to provide a simple, collapsable device for ease of handling.

It is a particular object of this invention to teach a stationary rowing unit comprising a frame; said frame has means defining a slideable seat in a generally horizontal attitude; means connecting said frame and said slideable seat; means defining a foot positioning element; a flywheel; braking means for said flywheel; a handle; means interposed between said flywheel and said rowing means for driving said flywheel; and return means for said drive means.

Further objects and features of this invention will become more apparent by reference to the following description, taken in conjunction with the accompanying figures in which:

FIG. 1 is a top plan view of the novel stationary rowing unit;

FIG. 2 is a side-elevational view thereof; and

FIG. 3 is an enlarged side-elevational view of the gearing mechanism.

As shown in the figures, a stationary rowing unit 10, comprised of a seat assembly 11, a rowing mechanism 12 and a flywheel assembly 13, are joined together. The seating assembly 11 consists of a seat 14 which rolls on a monorail 15. More details of the seat assembly will be shown in the following figure. The rowing mechanism 12 comprises a handle 16 connected to a chain 17 which in turn is tied into a chain return means 18 (shown in FIG. 2). The chain return means consists of an elastic cord which provides tension on the chain 17 for return of the handle 15 to its static position and the cord is attached at the opposite end to the monorail 15. The tension on the chain 17 can be changed by adjusting the tension of the chain return means 18. The flywheel assembly 13 comprises a flywheel 19 attached to the frame 20. The assembly 13 has a gearing mechanism 22, a one-way clutch assembly 23, and a plurality of fan-like devices 24 a–k. Also shown are the foot rests 25 and 25' and the tachometer/revolution counter 26. The chain 17 is positioned through the frame 20 by means of chain guides 31 and 31'.

The operator of the unit 10 would place himself on the seat 14. His feet would be inserted into foot rests 25 and 25' which have restraining straps 27 and 27' and adjustable heel supports 28 and 28'. The operator grasps the handle 16 and begins to row. The rowing action accelerates the flywheel 19 by means of the gear mechanism 22. The fan blade devices 24 a–k encounter air resistance which tends to decelerate the flywheel 19. As the operator returns for the next pull or rowing action, the return mechanism 18 takes up the slack in the rowing mechanism 12. This is quite different than a friction type resistance that one would set at the start of his exercise. Because the braking force is caused by air resistance, the force increases with the speed of the flywheel 19. FIG. 2 is a side elevational view of the stationary rowing unit 10. This view shows the unit in operation. The operator sits on the seat 14 which rolls on a monorail 15. The operator inserts his foot into the foot rest 25' and adjusts the heel support 28' and tightens the restraining strap 27. He grasps the handle 16 and pulls the handle 16 and straightens his legs. The chain 17 rotates the gearing mechanism 22 which turns the flywheel 19. A reading is shown on the tachometer 26. The fan blades 24 a–k act as a decelerating force.

FIG. 3 is an enlarged side elevational view of the gearing mechanism 22. This view shows the chain 17 looped around one gear 29 of a number of gears 29, **29*a*, and 29*b* on the sprocket 30, which houses the one-way clutch assembly 23. The chain may be changed from one gear to another to alter the operator's leverage necessary to accelerate the flywheel 19**.

While we have described our invention in connection with a specific embodiment thereof it is to be clearly understood that this is done only by way of example and not as a limitation to the scope of my invention as set forth in the objects thereof and in the appended claims.

I claim:

1. A stationary rowing unit, comprising:

a substantially horizontally-extended frame;

a seat engaged with said frame and moveable therealong in a generally horizontal translation;

means attached to said frame defining a foot positioning element;

a flywheel rotatably journaled in said frame;

braking means coupled to said flywheel for resisting rotation of said flywheel;

said braking means comprises a bladed fan;

an operating handle for causing rotation of said flywheel;

drive means coupling said flywheel and said handle for driving said flywheel in response to operation of said handle;

said drive means has interconnected plural gearing means for imparting a rotating moment on said flywheel;

return means for taking up slack in said drive means; and said return means being connected to said drive means beyond where said drive means interconnects with said plural gearing means and opposite said handle.

2. A unit, according to claim 1, wherein:

said frame comprises a monorail; and further including at least a pair of tubular means, coupled to said frame for supporting said monorail.

3. A unit, according to claim 1, further including:

means coupled to said flywheel, for prohibiting rotation of said flywheel in a given direction relative to said drive means.

4. A unit, according to claim 1, wherein said positioning element has at least one plate;

said plate has restraining means for restricting relative foot movement within proximity of said plate; and said angular plate has adjustable heel positioning means.

5. A unit, according to claim 1, wherein:

said drive means has a static and dynamic position;

said return means comprises elastic means for automatically returning said drive means to its static position; and said elastic means is attached at one end to said frame.

6. A unit, according to claim 1, wherein:

said flywheel has monitoring means.

* * * * *